US008714120B2

(12) United States Patent
Adams

(10) Patent No.: US 8,714,120 B2
(45) Date of Patent: May 6, 2014

(54) SINGLE COMPONENT INTAKE/EXHAUST VALVE MEMBER, FUEL DISTRIBUTION SYSTEM, AND COOLING SYSTEM FOR COMBUSTION-POWERED FASTENER-DRIVING TOOL

(75) Inventor: Joseph S. Adams, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 545 days.

(21) Appl. No.: 12/811,112

(22) PCT Filed: Dec. 30, 2008

(86) PCT No.: PCT/US2008/088515

§ 371 (c)(1),
(2), (4) Date: Sep. 29, 2010

(87) PCT Pub. No.: WO2009/088844

PCT Pub. Date: Jul. 16, 2009

(65) Prior Publication Data

US 2011/0005502 A1 Jan. 13, 2011

(51) Int. Cl.
*F01B 25/00* (2006.01)
*F01L 3/00* (2006.01)

(52) U.S. Cl.
USPC ..... 123/65 V; 123/65 R; 123/188.1

(58) Field of Classification Search
USPC ..... 123/65 R, 65 SP, 41 R, 50 R, 51 B, 190.4
See application file for complete search history.

(56) References Cited

U.S. PATENT DOCUMENTS 4,010,727 A * 3/1977 Cross et al. ..... 123/190.16
5,873,508 A 2/1999 MacVicar et al.
6,123,241 A 9/2000 Walter et al.
6,305,336 B1 * 10/2001 Hara et al. ..... 123/90.11
6,755,159 B1 6/2004 Adams et al.
8,171,909 B2 * 5/2012 Brusutti ..... 123/190.4
2006/0086335 A1 * 4/2006 Boulton ..... 123/190.4
2007/0000244 A1 * 1/2007 Barbero ..... 60/304

FOREIGN PATENT DOCUMENTS

EP 0424941 A1 5/1991
EP 1479483 A2 11/2004

OTHER PUBLICATIONS

ISR for PCT/US2008/088515 dated Apr. 28, 2009.

* cited by examiner

*Primary Examiner* — Lindsay Low
*Assistant Examiner* — Syed O Hasan
(74) *Attorney, Agent, or Firm* — Lowe Hauptman & Ham LLP

(57) ABSTRACT

A new and improved combustion-powered fastener-driving tool utilizes a new and improved single component in-take/exhaust valve member which integrally defines both the intake and exhaust valves thereon. The intake/exhaust valve member is axially movable within the combustion chamber, and operatively cooperates with wall structure of the combustion chamber. When the intake/exhaust valve member is disposed, for example, at a first upper position, both the intake and exhaust ports defined within the wall structure of the combustion chamber are closed so as to permit the ignition and combustion phases of the tool-firing cycle to proceed, whereas, conversely, when the intake/exhaust valve member is disposed, for example, at a second lower position, both the intake and exhaust ports within the combustion chamber are open so as to permit incoming air to scavenge combustion exhaust products and to subsequently mix with injected fuel in preparation for the commencement of another tool-firing cycle.

19 Claims, 7 Drawing Sheets

SINGLE COMPONENT INTAKE/EXHAUST VALVE MEMBER, FUEL DISTRIBUTION SYSTEM, AND COOLING SYSTEM FOR COMBUSTION-POWERED FASTENER-DRIVING TOOL

CROSS-REFERENCE TO RELATED PATENT APPLICATION

The present application is national phase of PCT/US2008/088515 filed Dec. 30, 2008, and claims priority from, U.S. Application No. 61/006,305 filed Jan. 4, 2008, the disclosures of which are hereby incorporated by reference herein in their entirety.

FIELD OF THE INVENTION

The present invention relates generally to combustion-powered fastener-driving tools, and more particularly to a new and improved single component intake/exhaust valve member, a fuel injection and distribution system, and a supplemental or auxiliary air flow system for a combustion-powered fastener-driving tool wherein the single component valve member is structured or configured for structurally cooperating with wall structure of the tool combustion chamber so as to effectively define both the intake and exhaust valve structure for the combustion-powered fastener-driving tool, wherein fuel injection manifold and accelerator plate structure is incorporated within the combustion chamber of the tool so as to enhance the uniform injection and distribution of the injected fuel throughout the combustion chamber, and wherein supplemental or auxiliary air flow components are operatively associated with the combustion chamber of the fastener-driving tool so as to enhance the cooling of the same, the mixing of the incoming air with the fuel injected into the combustion chamber, and the scavenging of the combustion exhaust products out from the combustion chamber.

BACKGROUND OF THE INVENTION

Combustion-powered fastener-driving tools are of course well known in the art. One example of such combustion-powered fastener driving tools is disclosed within U.S. Pat. No. Re. 32,452 which issued to Nikolich on Jul. 7, 1987. In order to achieve acceptable or desirable tool firing and fastener-driving cyclical operational rates, relatively large air intake and combustion product exhaust port and valve structures have been structurally and operationally incorporated within such fastener-driving tools as a result of the use or employment of longitudinally or axially sliding combustion chamber structures or sections. It can readily be appreciated, however, that as a result of such sliding combustion chamber structure, auxiliary cooling structure or devices cannot be readily incorporated upon or operatively associated with the combustion chamber. In addition, as a result of the longitudinally or axially sliding movements of such combustion chamber components, the opening and closing of the air inlet and combustion product exhaust ports and valves is directly dependent upon the axial or longitudinal movements or strokes of the sliding combustion chamber structure. Accordingly, it has been experienced that the operational cycles of such conventional combustion-powered fastener-driving tools are slower than conventional pneumatically-powered fastener-driving tools. Still further, it is also noted that in typically conventional PRIOR ART fastener-driving tools, such as, for example, that disclosed within Nikolich, that the fuel is injected into the combustion chamber at only a single location. This structural arrangement militates against the rapid uniform distribution and combustion of the fuel within and throughout the combustion chamber.

In addition, a fan is often incorporated within the upper region of the combustion chamber for any one of several reasons, such as, for example, facilitating or assisting the mixture of the air and fuel components being injected into the combustion chamber prior to ignition, providing a turbulent atmosphere within the combustion chamber in order to in fact promote the rapid burning of the air-fuel mixture within the combustion chamber once ignition has been initiated, scavenging of the combustion exhaust products by means of fresh air being induced into the combustion chamber subsequent to the combustion and power stroke phases of the fastener-driving tool, and cooling of the tool. However, it is not always ideal to dispose a fan at within the upper axial region of the combustion chamber in view of, for example, the thermal environment, the presence of pressure or shock forces to which the fan is normally subjected over extended operational periods, and the like. Accordingly, relatively small and low-mass fans are normally required to be used, as well as relatively sophisticated mounting systems for the fans in order to permit the same to withstand the aforenoted pressure or shock forces attendant each combustion cycle. It might therefore be desirable to relocate the fan to an alternate position, such as, for example, external to the combustion chamber, however, this then becomes problematic in that alternate means or modes of operation must be provided in order to achieve the mixing of the air and fuel components within the combustion chamber prior to the initiation of an ignition cycle, the development of turbulent conditions within the combustion chamber in order to facilitate the rapid burning of the air-fuel mixture with-in the combustion chamber, the induction of fresh air into the combustion chamber in order to achieve scavenging of the combustion exhaust products out from the combustion chamber subsequent to the combustion and power stroke phases of the fastener-driving tool, and the cooling of the tool.

A need therefore exists in the art for a new and improved combustion-powered fastener-driving tool wherein the intake and exhaust valve structure is effectively simplified so as to permit the intake and exhaust valve structure to be opened and closed in a rapid manner such that the cyclic operations of the combustion-powered fastener-driving tool can be comparable to those characteristic of conventional pneumatically-operated fastener-driving tools. A need also exists in the art for a new and improved combustion-powered fastener-driving tool wherein the cooling of the tool, the distribution and mixing of the air and fuel components within the combustion chamber of the tool just prior to the ignition and combustion of the air-fuel mixture within the combustion chamber, and the scavenging of the combustion exhaust products out from the combustion chamber can be achieved by means supplemental to, or in lieu of, the disposition or presence of a rotary fan within the upper region of the combustion chamber. Furthermore, a need exists in the art for a new and improved combustion-powered fastener-driving tool wherein the fuel can be uniformly introduced into, and distributed throughout, the tool combustion chamber so as to effectively accelerate the combustion of the same and the attainment of the peak combustion pressure within the combustion chamber during the power operational phase or stroke of the tool.

SUMMARY OF THE INVENTION

The foregoing and other objectives are achieved in accordance with the teachings and principles of the present invention through the provision of a new and improved combustion-powered fastener-driving tool which utilizes a new and improved single component intake/exhaust valve member which integrally defines both the intake and exhaust valves thereon. More particularly, the intake/exhaust valve member comprises an annular structure wherein, when viewed along a diametrically oriented cross-sectional slice or plane, the right side portion of the intake/exhaust valve member, for example, has a substantially C-shaped cross-sectional configuration whereas, for example, the left side portion of the intake-exhaust valve member has a substantially backwards oriented C-shaped cross-sectional configuration. The intake/exhaust valve member is adapted to be axially movable within the combustion chamber, and operatively cooperates with wall structure of the combustion chamber, such that when the intake-exhaust valve member is disposed, for example, at a first upper position, both the intake and exhaust ports defined within the wall structure of the combustion chamber are closed so as to permit the ignition and combustion phases of the tool-firing cycle to proceed, whereas, conversely, when the intake/exhaust valve member is disposed, for example, at a second lower position, both the intake and exhaust ports defined within the wall structure of the combustion chamber are open so as to permit incoming air to scavenge combustion exhaust products and to subsequently mix with injected fuel in preparation for the commencement of another tool-firing cycle.

A fan may be disposed within the upper axial region of the combustion chamber in order to assist the intake of the incoming air, the exhaust of the combustion exhaust products, the mixing of the air-fuel mixture components, and the cooling of the combustion chamber, or alternatively, a supplemental flower or fan system, disposed externally of the combustion chamber may be utilized to augment the functions of the fan disposed within the combustion chamber. Alternatively, still further, the fan may be eliminated from combustion chamber, and a fuel injection manifold and accelerator plate system may be disposed at an axial position within the combustion chamber so as to effectively provide uniform injection and distribution of the fuel into the combustion chamber, as well as the formation of turbulent conditions within the combustion chamber so as to ensure and maximize the mixing of the air and fuel components and the propagation of multiple flame fronts or jets within the combustion chamber.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1A:
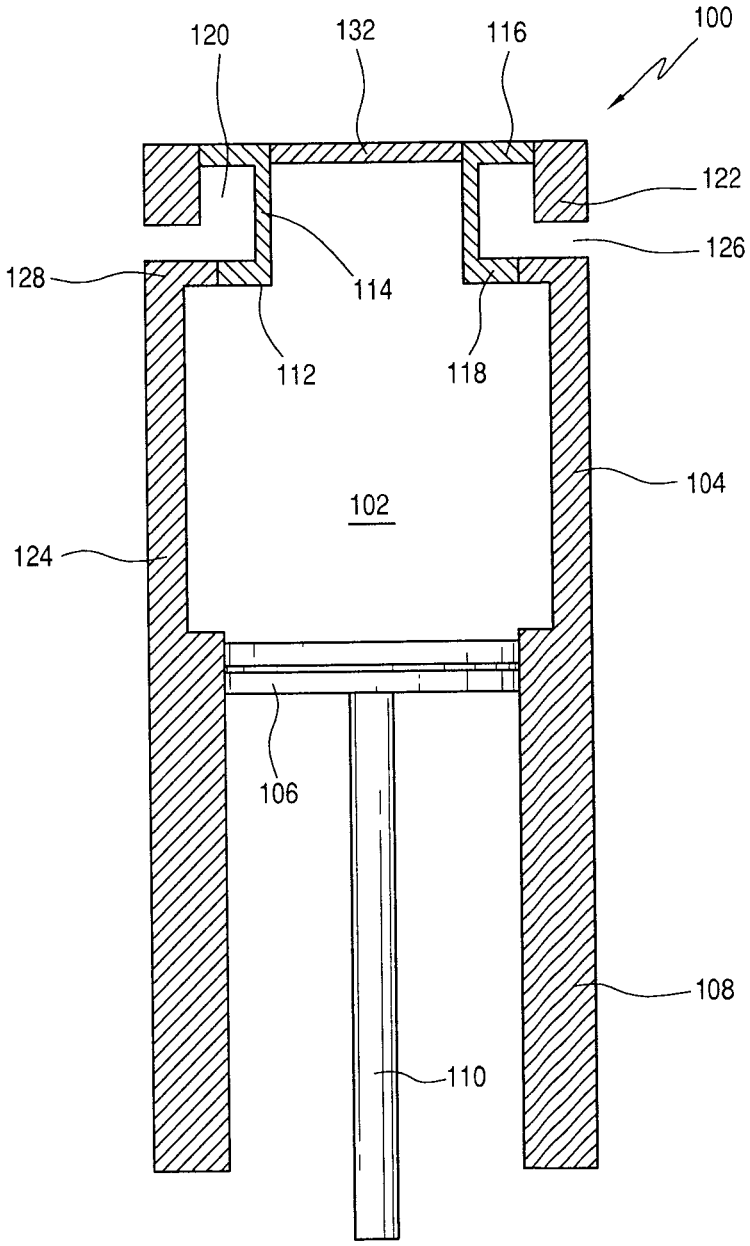
FIG. 1*a* is a schematic vertical cross-sectional view of a first embodiment of a new and improved combustion chamber and piston-cylinder system of a combustion-powered fastener-driving tool and illustrating a new and improved single component intake/exhaust valve member, as constructed in accordance with the principles and teachings of the present invention and showing the cooperative parts thereof, wherein the single component intake/exhaust valve member is illustrated as being disposed at its first upper closed position.
Figure 1B:
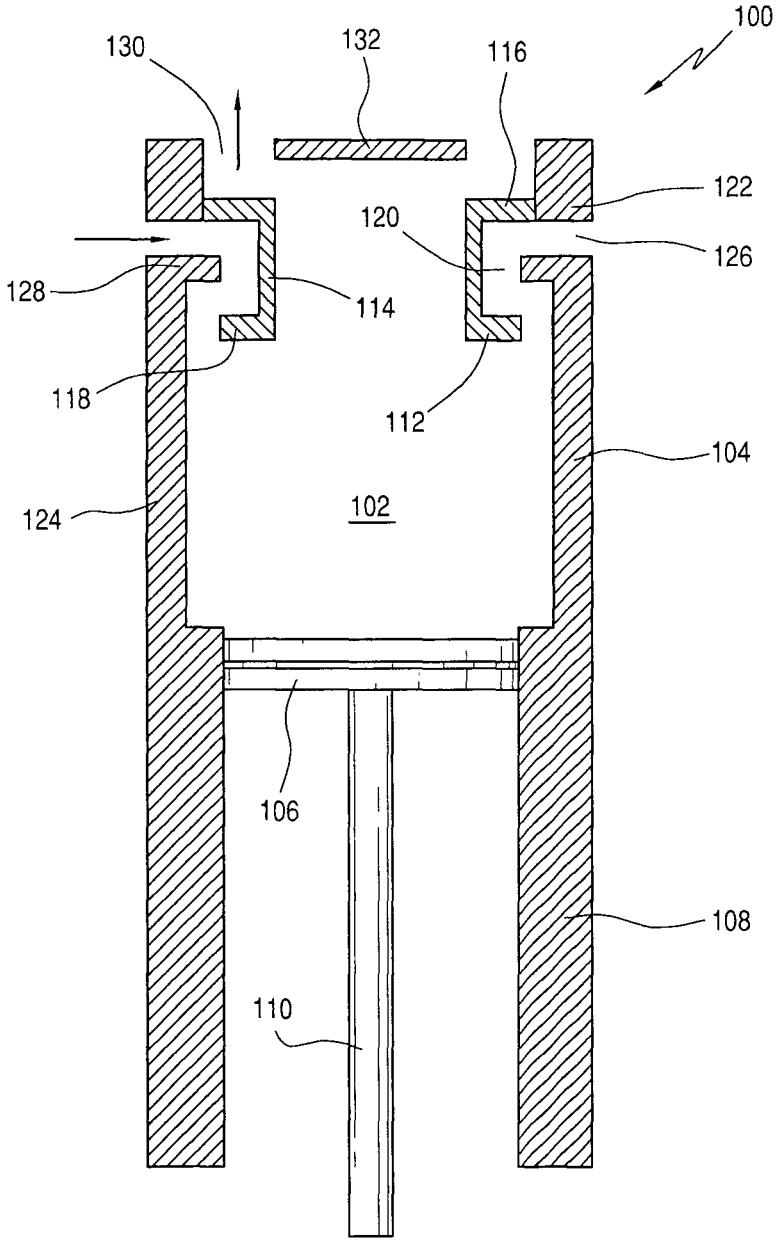
FIG. 1*b* is a schematic vertical cross-sectional view of the first embodiment combustion chamber and piston-cylinder system of the combustion-powered fastener-driving tool, as illustrated in FIG. 1*a*, and illustrating the new and improved single component intake/exhaust valve member, as constructed in accordance with the principles and teachings of the present invention and showing the cooperative parts thereof, wherein the single component intake/exhaust valve member is illustrated as being disposed at its second lower open position.

Referring now to the drawings, and more particularly to FIGS. 1*a* and 1*b* thereof, a first embodiment of a new and improved combustion chamber and piston-cylinder system, having a new and improved intake/exhaust valve structure, as constructed in accordance with the principles and teachings of the present invention, incorporated within the combustion chamber and piston-cylinder system, is illustrated and is generally indicated by the reference character 100. More particularly, it is seen that the first embodiment combustion chamber and piston-cylinder system 100 comprises a combustion chamber 102, as defined internally within a substantially cylindrically shaped combustion chamber housing 104, and a working piston 106 movably disposed in a vertically reciprocal manner within a surrounding cylinder 108. The working piston 106 has a driver blade or similar fastener-driving implement 110 fixedly attached to the undersurface portion thereof, and it is seen that the upper surface portion of the working piston 106 is disposed within the lower end portion of the combustion chamber 102 so as to be operatively exposed to the pressures and forces developed within the combustion chamber 102 during the power phase of a combustion cycle. In accordance with the particular principles and teachings of the present invention, it is also seen that the new and improved combustion chamber and piston-cylinder system 100 comprises a new and improved single component intake/exhaust valve member 112 disposed therein so as to be vertically movable in a reciprocal manner between a first upper closed position, as illustrated within FIG. 1*a*, and a second lower open position as illustrated within FIG. 1*b*.

More particularly, it is seen that the new and improved single component intake/exhaust valve member 112 has an annular structure comprising a main annular body portion 114, a first, upper radially outwardly projecting annular flange portion 116, and a second lower radially outwardly projecting annular flange portion 118, wherein the main body portion 114, the upper flange portion 116, and the lower flange portion 118 effectively cooperate together so as to define an axially intermediate annular groove portion 120 through which the incoming intake air will be routed as will become more apparent hereinafter. In a corresponding manner, it is seen that the combustion chamber housing 104 comprises an upper annular side wall portion 122, a lower annular side wall portion 124, and an annular air intake port 126 defined within a side wall portion of the combustion chamber housing 104 so as to be interposed between the upper and lower side wall portions 122,124.

The annular air intake port 126 can effectively comprise an annular slot or a multiplicity of circumferentially separated ports with the residual portions of the upper and lower side wall portions 122,124 of the combustion chamber housing 104 being fixedly secured to the overall tool structure as necessary. Still yet further, a radially inwardly projecting flange portion 128 is fixedly secured to the upper edge portion of the lower side wall portion 124 of the combustion chamber housing 104, and an annular exhaust port 130 is defined within the upper end wall member 132 of the combustion chamber housing 104. As was the case with the annular air intake port 126, the annular exhaust port 130 can comprise an annular slot or a multiplicity of circumferentially separated ports with the residual portions of the upper end wall member 132 of the combustion chamber housing 104 being fixedly secured to the overall tool structure as necessary.

Accordingly, as can readily be appreciated as a result of a comparison being made between FIGS. 1*a* and 1*b*, when the new and improved single component intake exhaust valve member 112 is disposed at its first upper closed position as illustrated within FIG. 1*a*, the upper annular flange portion 116 of the intake/exhaust valve member 112 will be disposed within the annular exhaust port 130 so as to be substantially coplanar with the upper end wall member 132 of the combustion chamber housing 104 and thereby close the annular exhaust port 130. In a similar manner, since the radially outer annular edge portion of the upper annular flange portion 116 is engaged or mated with the internal peripheral surface portion of the upper side wall portion 122 of the combustion chamber housing 104, and since the radially outer annular edge portion of the lower annular flange portion 118 is engaged or mated with the radially inner edge portion of the radially inwardly projecting flange portion 128 fixedly secured to the upper edge portion of the lower side wall portion 124 of the combustion chamber housing 104, air tending to enter the annular air intake port 126 is effectively blocked and prevented from entering the combustion chamber 102. It is of course to be appreciated that piston ring type seals, not shown, may be disposed upon the various portions of the combustion chamber housing 104, and/or upon the intake/exhaust valve member 112, in order to seal such structures with respect to each other when, for example, the intake/exhaust valve member 112 is disposed at its upper closed position.

Conversely, when the new and improved single component intake exhaust valve member 112 is disposed at its second lower opened position as illustrated within FIG. 1*b*, the upper annular flange portion 116 of the intake/exhaust valve member 112 will be disengaged from or unseated with respect to the annular exhaust port 130, thereby opening the annular exhaust port 130. In a similar manner, while the radially outer annular edge portion of the upper annular flange portion 116 is still engaged or mated with the internal peripheral surface portion of the upper side wall portion 122 of the combustion chamber housing 104, the radially outer annular edge portion of the lower annular flange portion 118 will be disengaged from the radially inner edge portion of the radially inwardly projecting flange portion 128 fixedly secured to the upper edge portion of the lower side wall portion 124 of the combustion chamber housing 104.

Accordingly, incoming air, entering the annular air intake port 126, is effectively routed in a substantially sinusoidal manner through the air intake port 126, around the radially inner edge portion of the radially inwardly projecting flange portion 128, through the annular groove portion 120 of the intake/exhaust valve member 112, and into the combustion chamber 102, and of course, combustion exhaust products can simultaneously flow outwardly through the exhaust port 130 so as to scavenge the combustion chamber 102. It is to be lastly noted that the vertically axial reciprocal movements of the intake/exhaust valve member 112, between its closed and opened positions, can be controlled, for example, as a result of various linkages, structural connections, and the like effectively interconnecting the intake/exhaust valve member 112 to the trigger and workpiece contact element members, not shown, of the fastener-driving tool.

Figure 2:
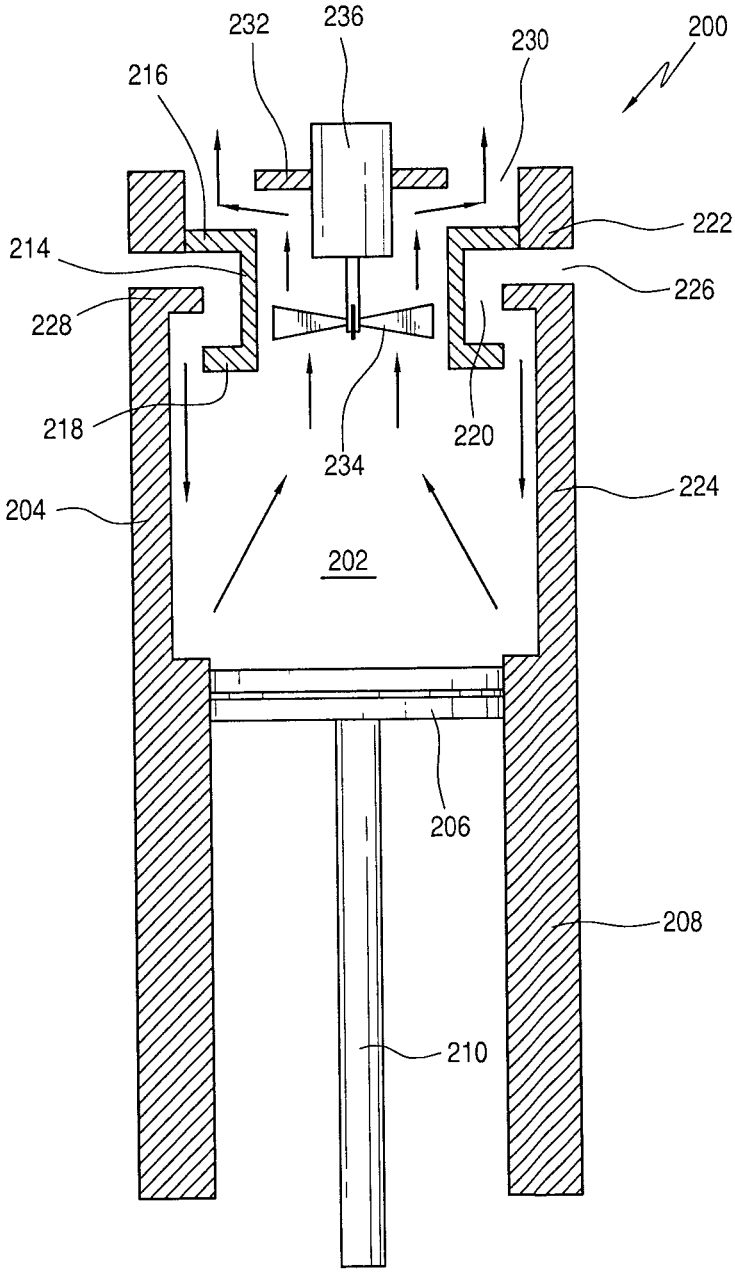
FIG. 2 is a schematic vertical cross-sectional view of a second embodiment combustion chamber and piston-cylinder system of a combustion-powered fastener-driving tool, similar to that illustrated within FIG. 1, and including the new and improved single component intake/exhaust valve member as constructed in accordance with the principles and teachings of the present invention and showing the cooperative parts thereof, wherein the intake/exhaust valve member is disclosed at its open position so as to permit, for example, the scavenging of combustion exhaust products, and wherein further, a conventional intake and exhaust fan has been incorporated within the combustion chamber at the upper axially central position thereof.

With reference now being made to FIG. 2, a second embodiment combustion chamber and piston-cylinder system of a combustion-powered fastener-driving tool, similar to that illustrated within FIG. 1, and including the new and improved single component intake/exhaust valve member as constructed in accordance with the principles and teachings of the present invention and showing the cooperative parts thereof, is disclosed and is generally indicated by the reference character 200. It is noted that in view of the basic similarities of the first and second embodiment combustion chamber and piston-cylinder systems 100,200 as respectively disclosed within FIGS. 1 and 2, except as will be disclosed and discussed hereinafter, a detailed description of the second embodiment combustion chamber and piston-cylinder system 200 will be omitted herefrom for brevity purposes. In addition, component parts of the second embodiment combustion chamber and piston-cylinder system 200 which correspond to component parts of the first embodiment combustion chamber and piston-cylinder system 100 will be designated by corresponding reference characters except that they will be within the 200 series.

More particularly, it is seen that the primary difference between the first and second embodiment combustion chamber and piston-cylinder systems 100,200 resides in the fact that, in accordance with the principles and teachings of the present invention, the second embodiment combustion chamber and piston-cylinder system 200 comprises the use of a conventional intake and exhaust fan 234 which has been incorporated within the combustion chamber 202 at the upper axially central position thereof as one exemplary means for inducing the incoming air to enter the air intake port 226 and the combustion chamber 202, while simultaneously forcing or expelling the combustion exhaust products out from the combustion chamber 202 through means of the exhaust port 230. The intake and exhaust fan 234 is adapted to be driven by means of a suitable motor 236 that is fixedly mounted, for example, within the upper end wall member 232 of the combustion chamber housing 204.

Figure 3:
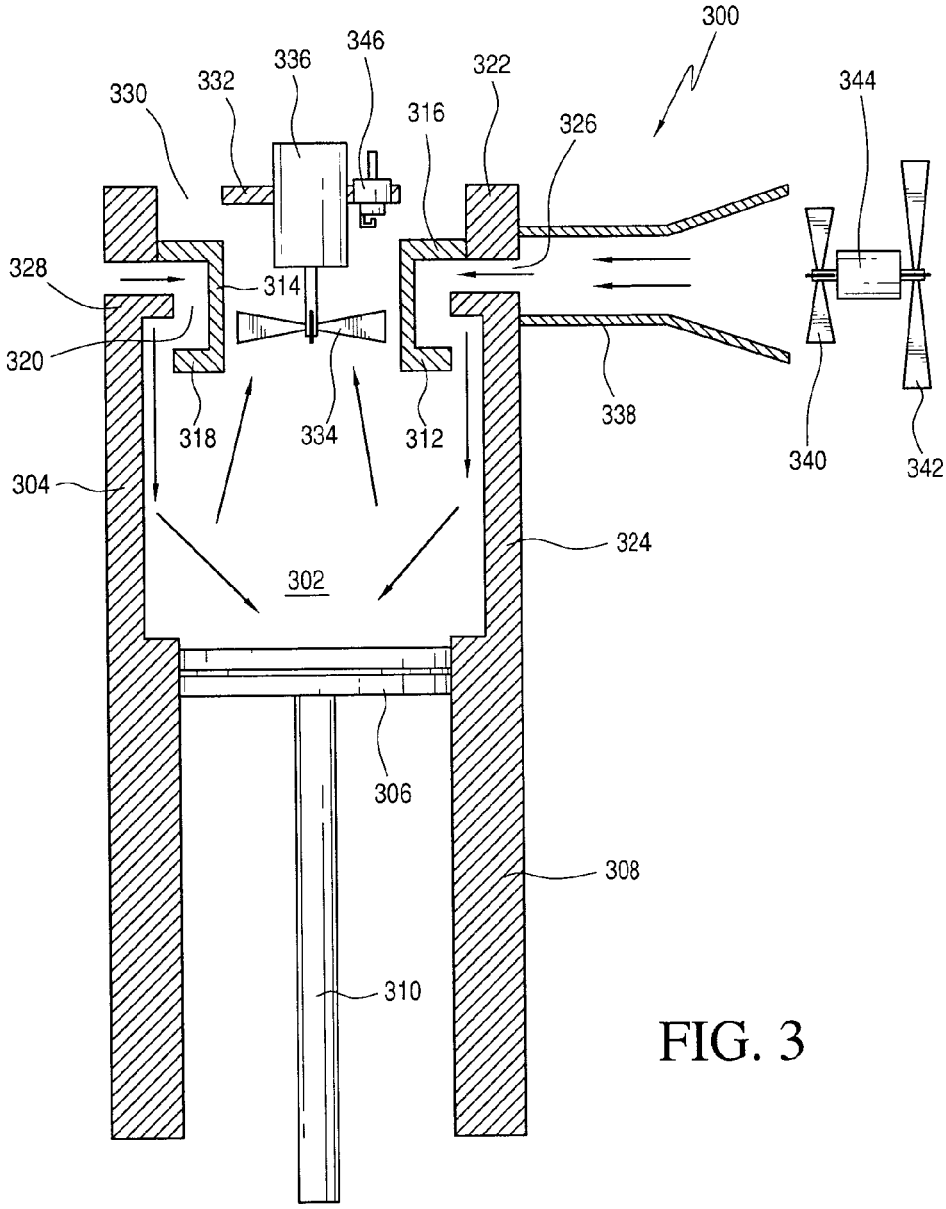
FIG. 3 is a schematic vertical cross-sectional view of a third embodiment of a combustion chamber and piston-cylinder system of a combustion-powered fastener-driving tool similar to that illustrated within FIG. 2, and including the new and improved single component intake/exhaust valve member as constructed in accordance with the principles and teachings of the present invention and showing the cooperative parts thereof, wherein the intake/exhaust valve member is disclosed at its open position so as to permit, for example, the scavenging of combustion exhaust products, and wherein further, a supplemental dual-fan system, disposed externally of the combustion chamber, has been provided in order to assist or augment the intake of air into the combustion chamber and the external cooling of the combustion chamber.

With reference now being made to FIG. 3, a third embodiment combustion chamber and piston-cylinder system of a combustion-powered fastener-driving tool, similar to that illustrated within FIG. 2, and including the new and improved single component intake/exhaust valve member as constructed in accordance with the principles and teachings of the present invention and showing the cooperative parts thereof, is disclosed and is generally indicated by the reference character 300. It is noted that in view of the basic similarities of the second and third embodiment combustion chamber and piston-cylinder systems 200,300 as respectively disclosed in FIGS. 2 and 3, except as will be disclosed and discussed hereinafter, a detailed description of the third embodiment combustion chamber and piston-cylinder system 300 will be omitted herefrom for brevity purposes. In addition, component parts of the third embodiment combustion chamber and piston-cylinder system 300 which correspond to component parts of the second embodiment combustion chamber and piston-cylinder system 200 will be designated by corresponding reference characters except that they will be within the 300 series. More particularly, it is seen that the primary difference between the second and third embodiment combustion chamber and piston-cylinder systems 200,300 resides in the fact that, in accordance with the principles and teachings of the present invention, the third embodiment combustion chamber and piston-cylinder system 300 comprises the use of a supplemental or auxiliary airflow system for not only forcing air into the combustion chamber 302 through means of the air intake port 326, but in addition, for forcing cooling air around the external surface portion of the combustion chamber housing 304 in order to cool the same. The supplemental or auxiliary airflow system is seen to comprise an air duct 338 which is fixedly secured to the external surface portion of the combustion chamber housing 304 wherein the downstream end portion of the air duct 338 is fluidically connected to the air intake port 326 of the combustion chamber 304. In addition, a dual-fan system, comprising first and second fans 340,342 operatively driven by means of a suitable motor 344, are disposed immediately upstream of the mouth or entrance of the air duct 338 such that the air flow induced by means of the first fan 340 is forced to flow into the air duct 338 while a portion of the air flow induced by means of the second fan 342 flows around the external surface portion of the air duct 338 and, in turn, around the combustion chamber housing 304, so as to cool the latter. It is lastly noted that a suitable ignition device, such as, for example, a spark plug 346, is illustrated as being mounted within the upper end wall member 332 of the combustion chamber housing 304 so as to initiate ignition and combustion of the air-fuel mixture within the combustion chamber 302.

Figure 4:
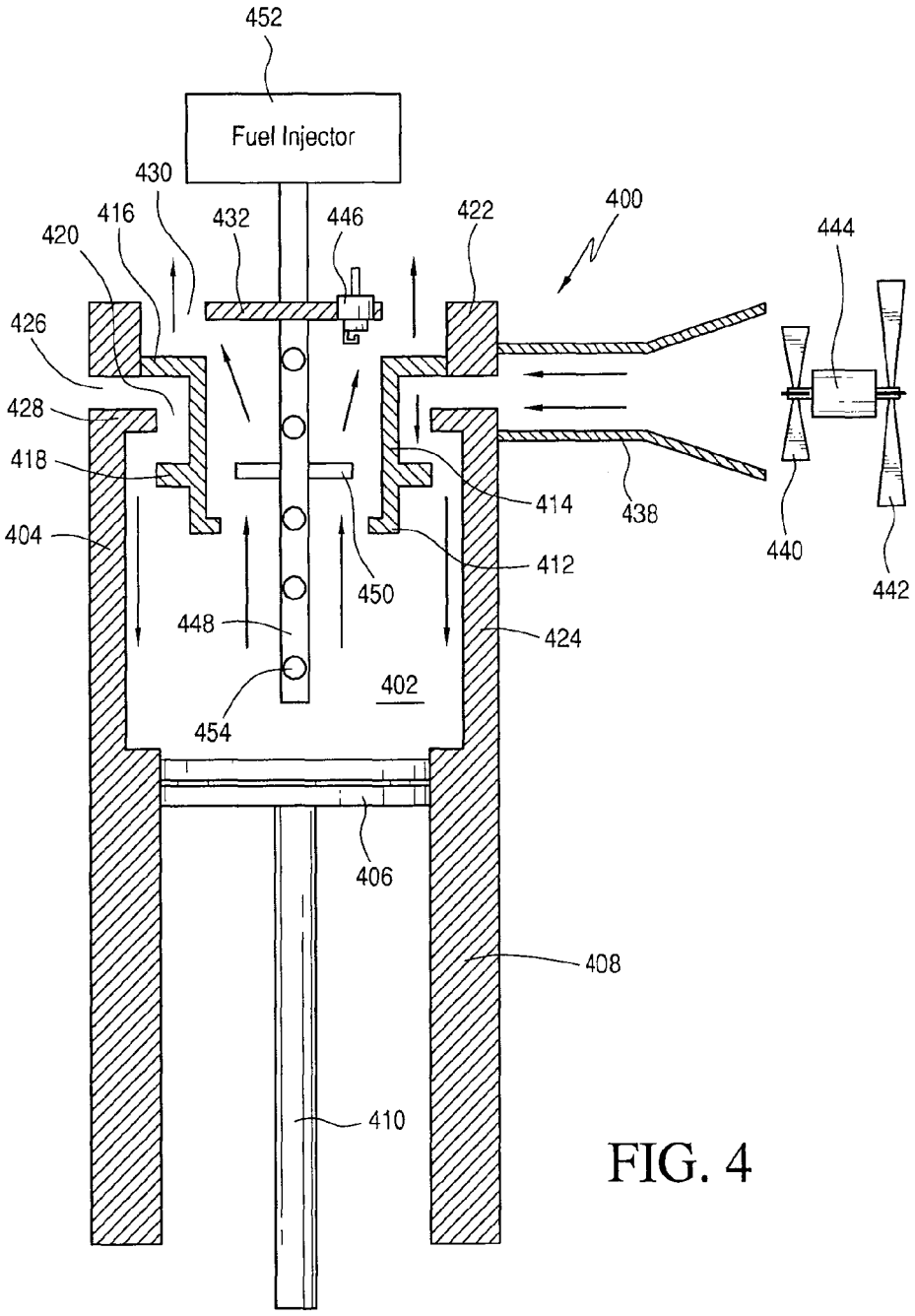
FIG. 4 is a schematic vertical cross-sectional view of a fourth embodiment combustion chamber and piston-cylinder system of a combustion-powered fastener-driving tool, similar to the third embodiment combustion chamber and piston-cylinder system illustrated within FIG. 3, and including the new and improved single component intake/exhaust valve member as constructed in accordance with the principles and teachings of the present invention and showing the cooperative parts thereof, wherein the intake/exhaust valve member is disclosed at its open position so as to permit, for example, the scavenging of combustion exhaust products, and wherein further, the fan, disposed within the combustion chamber at the upper axially central region thereof, as illustrated within the third embodiment of FIG. 3, has been removed, and in lieu thereof, a fuel injection manifold and accelerator plate system has been disposed so as to uniformly inject and distribute the injected fuel into and throughout the combustion chamber as well as to cause turbulent conditions to be developed within the combustion chamber so as to promote the rapid burning of the air fuel mixture within the combustion chamber.
Figure 5:
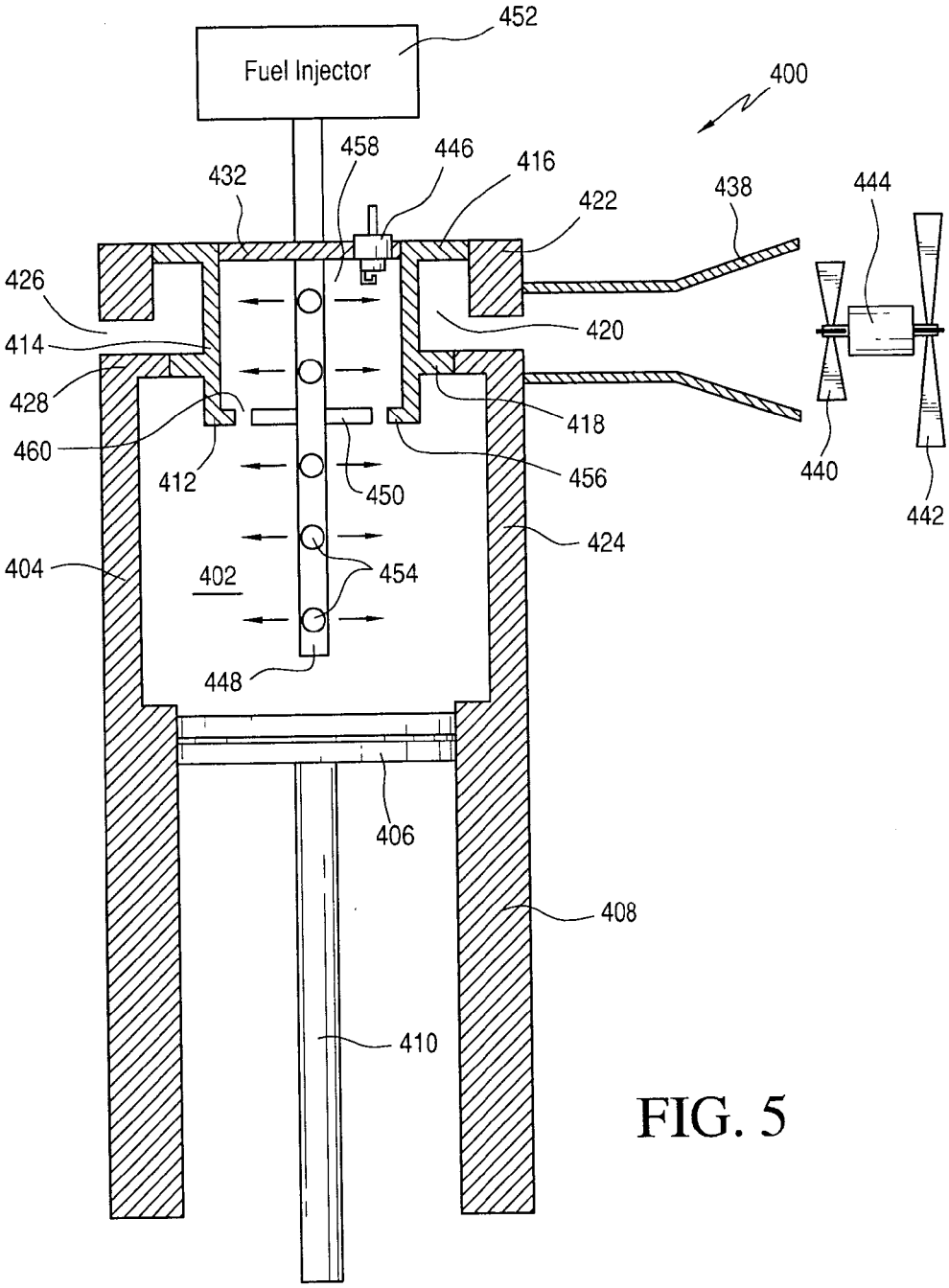
FIG. 5 is a schematic vertical cross-sectional view of the fourth embodiment combustion chamber and piston-cylinder system of the combustion-powered fastener-driving tool as illustrated within FIG. 4, and including the new and improved single component intake/exhaust valve member as constructed in accordance with the principles and teachings of the present invention and showing the cooperative parts thereof, wherein the intake/exhaust valve member is disposed at its closed position and the fuel is illustrated as actually being injected into the combustion chamber.

Referring now to FIGS. 4 and 5, a fourth embodiment combustion chamber and piston-cylinder system of a combustion-powered fastener-driving tool, similar to that illustrated within FIG. 3, and including the new and improved single component intake/exhaust valve member as constructed in accordance with the principles and teachings of the present invention and showing the cooperative parts thereof, is disclosed and is generally indicated by the reference character 400. It is noted that in view of the basic similarities of the third and fourth embodiment combustion chamber and piston-cylinder systems 300,400 as respectively disclosed in FIGS. 3 and 4-5, except as will be disclosed and discussed hereinafter, a detailed description of the fourth embodiment combustion chamber and piston-cylinder system 400 will be omitted herefrom for brevity purposes. In addition, component parts of the fourth embodiment combustion chamber and piston-cylinder system 400 which correspond to component parts of the third embodiment combustion chamber and piston-cylinder system 300 will be designated by corresponding reference characters except that they will be within the 400 series.

More particularly, it is seen that the primary difference between the third and fourth embodiment combustion chamber and piston-cylinder systems 300,400 resides in the fact that, in accordance with the principles and teachings of the present invention, the conventional intake and exhaust fan 334, previously disclosed as being disposed within the combustion chamber 302, has been removed from the combustion chamber 402, and in lieu thereof, the fourth embodiment combustion chamber and piston-cylinder system 400 comprises the disposition of a vertically or axially oriented fuel injection manifold 448 and a horizontally or transversely oriented accelerator plate 450 within the combustion chamber 402, wherein the accelerator plate 450 comprises a plurality of through-apertures, not shown. Fuel is conducted to the fuel injection manifold 448 by means of a fuel injector 452, and it is seen that the fuel injection manifold 448 comprises a plurality of vertically spaced fuel discharge ports 454 for discharging fuel radially outwardly into the combustion chamber 402 as disclosed within FIG. 5. In addition, it is also seen that the axial extent of the main annular body portion 414 has been extended such that the lower end portion thereof extends beneath the second lower radially outwardly projecting annular flange portion 418 and has a radially inwardly projecting annular flange portion 456 disposed thereon. Accordingly, when the intake/exhaust valve member 412 is disposed at its upper closed position, as illustrated within FIG. 5, the radially inwardly projecting annular flange portion 456 of the intake/exhaust valve member 412 will effectively be aligned with, and disposed in a coplanar manner with respect to, the transversely oriented accelerator plate 450.

In this manner, it can be further appreciated that when the intake/exhaust valve member 412 is disposed at its upper closed position, the upper wall member 432 of the combustion chamber housing 404, the upper annular flange portion 416 of the intake/exhaust valve member 412, the main body portion 414 of the intake/exhaust valve member 412, the accelerator plate 450, and the radially inwardly projecting annular flange portion 456 of the intake/exhaust valve member 412 will together define a pre-combustion chamber 458 within which combustion will be initiated when the spark plug 446 is energized. Accordingly, when ignition and combustion is in fact initiated, the forces, generated within the pre-combustion chamber 458, will cause turbulence and eddy currents to be developed within the pre-combustion chamber 458 and also tend to force the air-fuel mixture, and the flame front developed thereby, through the multiplicity of through-bores or through-apertures defined within the accelerator plate 450 as well as through the annular space 460 defined between the radially outer peripheral edge portion of the accelerator plate 450 and the radially inner peripheral edge portion of the radially inwardly projecting annular flange portion 456 of the intake/exhaust valve member 412 whereby multiple flame fronts or multiple jets will effectively be formed or developed within and throughout the combustion chamber 402. These various forces, flame fronts, combustion jets, and the like, of course serve to achieve the uniform, evenly distributed, and rapid combustion of the air-fuel mixture throughout the entire combustion chamber 402.

Figure 6:
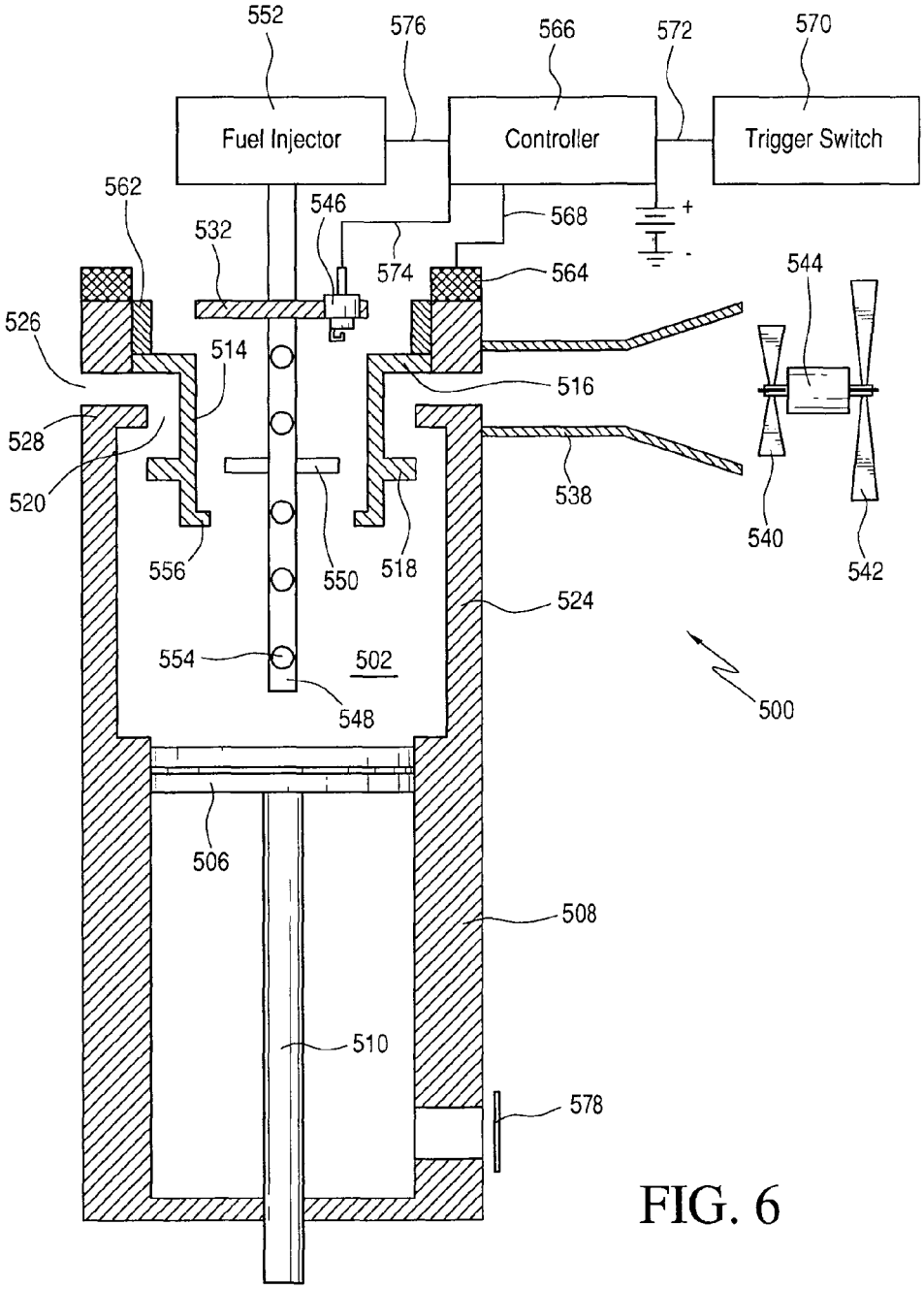
FIG. 6 is a schematic vertical cross-sectional view of a fifth embodiment combustion chamber and piston-cylinder system of a combustion-powered fastener-driving tool similar to that illustrated within FIGS. 4 and 5, and including the new and improved single component intake/exhaust valve member as constructed in accordance with the principles and teachings of the present invention and showing the cooperative parts thereof, wherein the intake/exhaust valve member is disclosed at its open position so as to permit, for example, the scavenging of combustion exhaust products, and wherein further, electromagnetic structure has been operatively associated with the combustion chamber wall structure so as to assist or control the movements of the single component intake/exhaust valve member between its first upper closed position and its second lower open position.

With reference now lastly being made to FIG. 6, a fifth embodiment combustion chamber and piston-cylinder system of a combustion-powered fastener-driving tool, similar to that illustrated within FIGS. 4 and 5, and including the new and improved single component intake/exhaust valve member as constructed in accordance with the principles and teachings of the present invention and showing the cooperative parts thereof, is disclosed and is generally indicated by the reference character 500. It is noted that in view of the basic similarities of the fourth and fifth embodiment combustion chamber and piston-cylinder systems 400,500 as respectively disclosed in FIGS. 4-5 and 6, except as will be disclosed and discussed hereinafter, a detailed description of the fifth embodiment combustion chamber and piston-cylinder system 500 will be omitted herefrom for brevity purposes. In addition, component parts of the fifth embodiment combustion chamber and piston-cylinder system 500 which correspond to component parts of the fourth embodiment combustion chamber and piston-cylinder system 400 will be designated by corresponding reference characters except that they will be within the 500 series. More particularly, it is seen that the primary difference between the fourth and fifth embodiment combustion chamber and piston-cylinder systems 400,500 resides in the fact that, in accordance with the teachings and principles of the present invention, the upper annular flange portion 516 of the intake/exhaust valve member 512 is provided with an upstanding annular ring member 562, which is fabricated from a suitable magnetically permeable material, and an annularly configured electromagnet 564 is disposed atop the upper end wall member 532 of the combustion chamber housing 504 within the outer peripheral region thereof.

The electromagnet 564 is electrically connected to a suitable controller 566, such as, for example, a programmable logic controller (PLC) by means of a suitable signal line 568, and the controller 566 is also electrically connected to a trigger switch mechanism 570 of the fastener-driving tool by means of a suitable signal line 572. Still yet further, the controller 566 is electrically connected to the ignition device or spark plug 546 by means of a signal line 574, and is also electrically connected to the fuel injector 552 by means of a signal line 576. In this manner, when, for example, both the trigger switch mechanism 570 and the nosepiece contact element, not shown, are disposed at their actuated positions so as to permit the fastener-driving tool to be fired, the controller 566 will receive a suitable signal from the trigger switch mechanism 570 that ignition can be initiated, and accordingly, the controller 566 will send a first suitable control signal along signal line 568 to the electromagnet 564 so as to energize the same and therefore cause the intake/exhaust valve member 512 to be moved to its upper closed position, the controller 566 will also send a second suitable control signal along signal line 576 to the fuel injector 552 so as to cause fuel to be injected into the combustion chamber 502 through means of the fuel injection manifold 548, and lastly, the controller 566 will also send a third suitable control signal along signal line 574 to the ignition device or spark plug 546 so as to initiate ignition and combustion of the air-fuel mixture disposed within the combustion chamber 502. It is also noted that an exhaust check valve 578 is disposed within a lower side wall portion of the cylinder 508 so as to permit air, disposed beneath the working piston 506, to escape from the cylinder 508 when the working piston 506 moves downwardly within the cylinder 508 during a fastener-driving power stroke. Lastly, while a single electromagnet 564 is utilized to control both the upward and downward movements of the intake/exhaust valve member 512, separate electromagnets could possibly be used for separately and respectively controlling the upward and downward movements of the intake/exhaust valve member 512.

Thus, it may be seen that in accordance with the principles and teachings of the present invention, there has been disclosed a new and improved single component intake-exhaust valve member, a fuel injection and distribution system, and a supplemental or auxiliary air flow system for a combustion-powered fastener-driving tool wherein the single component valve member is structured or configured for structurally cooperating with wall structure of the tool combustion chamber so as to effectively define both the intake and exhaust valve structure for the combustion-powered fastener-driving tool. The fuel injection manifold and accelerator plate structure is incorporated within the combustion chamber of the tool so as to enhance the uniform injection and distribution of the injected fuel throughout the combustion chamber, and the supplemental or auxiliary air flow components are operatively associated with the combustion chamber of the fastener-driving tool so as to enhance the cooling of the same, the mixing of the incoming air with the fuel injected into the combustion chamber, and the scavenging of the combustion exhaust products out from the combustion chamber.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combustion chamber system comprising: a combustion chamber defined around an axis and into which an air-fuel mixture is to be charged; ignition means disposed within said combustion chamber for igniting the air-fuel mixture disposed within said combustion chamber; and a single component intake/exhaust valve that has a passageway therethrough and is movable along a linear path relative to a wall structure of the combustion chamber between first CLOSED and second OPEN positions for controlling the intake of air into said combustion chamber and the exhaust of combustion products out from said combustion chamber.

2. The combustion chamber system as set forth in claim 1, wherein:

a first combustion air intake port is defined with-in an upper side wall portion of said combustion chamber;

a second combustion product exhaust port is defined within an upper wall portion of said combustion chamber; and said single component intake/exhaust valve has an annular configuration which permits combustion air to enter said first combustion air intake port for flow into said combustion chamber, and for permitting combustion products to be exhausted from said combustion chamber through said second combustion product exhaust port, when said single component intake/exhaust valve is disposed at said second OPEN position, and prevents combustion air from entering said first combustion air intake port for flow into said combustion chamber, and for preventing combustion products from being exhausted from said combustion chamber through said second combustion product exhaust port, when said single component intake/exhaust valve is disposed at said first CLOSED position.

3. The combustion chamber system as set forth in claim 2, wherein:

said annularly configured single component intake-exhaust valve and said upper wall portion of said combustion chamber defining said second combustion product exhaust port comprise oppositely oriented flanged portions such that when said single component intake/exhaust valve is disposed at said first OPEN position, the combustion air entering said first combustion air intake port for flow into said combustion chamber will traverse a sinusoidal flow path.

4. The combustion chamber system as set forth in claim 3, further comprising:

an intake/exhaust fan disposed within said combustion chamber for inducing said combustion air to enter said combustion chamber and for forcing said exhaust products out from said combustion chamber when said single component in-take/exhaust valve is disposed at said first OPEN position.

5. The combustion chamber system as set forth in claim 3, further comprising:

a supplemental airflow system operatively associated with said combustion chamber system and disposed externally of said combustion chamber for causing combustion air to enter said combustion chamber through said first combustion air intake port defined within said upper side wall portion of said combustion chamber and for causing additional ambient air to cool external side wall portions of said combustion chamber.

6. The combustion chamber system as set forth in claim 5, wherein said supplemental airflow system comprises:

an air duct fluidically connected to said first combustion air intake port defined within said upper side wall portion of said combustion chamber; and a dual-fan system comprising a first fan for con-ducting air into said air duct fluidically connected to said first combustion air intake port defined within said upper side wall portion of said combustion chamber, and a second fan for conducting ambient air onto said external side wall portions of said combustion chamber so as to cool said external side wall portions of said combustion chamber.

7. The combustion chamber system as set forth in claim 3, further comprising:

an axially oriented fuel injection manifold disposed within said combustion chamber for distributing fuel into and throughout said combustion chamber.

8. The combustion chamber system as set forth in claim 7, further comprising:

an accelerator plate fixedly mounted upon said axially oriented fuel injection manifold, disposed transversely with respect to said axially oriented fuel injection manifold, and having apertures defined therein for defining multiple flame fronts to be generated within said combustion chamber.

9. The combustion chamber system as set forth in claim 8, further comprising:

additional flanged means disposed upon said annularly configured single component intake/exhaust valve and adapted to be disposed adjacent to said accelerator plate when said single component intake/exhaust valve is disposed at said first CLOSED position such that when said single component intake/exhaust valve is disposed at said first CLOSED position said upper wall member of said combustion chamber, said single component intake/exhaust valve, and said accelerator plate together define a pre-combustion chamber.

10. The combustion chamber system as set forth in claim 1, further comprising:

electromagnetic means for moving said single component intake/exhaust valve between said first CLOSED and second OPEN positions within said combustion chamber.

11. The combustion chamber system as set forth in claim 1, wherein the valve is a reciprocating valve.

12. A combustion device, comprising:

a combustion chamber; and a single component intake/exhaust valve configured to move along a trajectory in a repetitious manner relative to the combustion chamber such that at least a portion of the trajectory extends into said combustion chamber, wherein movement of the valve along the trajectory in the repetitious manner causes the valve to move between first CLOSED and second OPEN positions for controlling the intake of air into said combustion chamber and the exhaust of combustion products out from said combustion chamber, wherein a first combustion air intake port is defined with-in an upper side wall portion of said combustion chamber;

a second combustion product exhaust port is defined within an upper wall portion of said combustion chamber; and said single component intake/exhaust valve has an annular configuration configured to permit combustion air to enter said first combustion air intake port for flow into said combustion chamber, and for permitting combustion products to be exhausted from said combustion chamber through said second combustion product exhaust port, when said single component intake/exhaust valve is disposed at said second OPEN position, and prevents combustion air from entering said first combustion air intake port for flow into said combustion chamber, and for preventing combustion products from being exhausted from said combustion chamber through said second combustion product exhaust port, when said single component intake/exhaust valve is disposed at said first CLOSED position.

13. The device of claim 12, wherein:

said annularly configured single component intake-exhaust valve and said upper wall portion of said combustion chamber defining said second combustion product exhaust port comprise oppositely oriented flanged portions such that when said single component intake/exhaust valve is disposed at said first OPEN position, the combustion air entering said first combustion air intake port for flow into said combustion chamber will traverse a sinusoidal flow path.

14. The device of claim 13, further comprising:

an intake/exhaust fan disposed within said combustion chamber configured to induce combustion air to enter said combustion chamber and configured to force said exhaust products out from said combustion chamber when said single component in-take/exhaust valve is disposed at said first OPEN position.

15. The device of claim 13, further comprising:

a supplemental airflow system operatively associated with said combustion chamber system and disposed externally of said combustion chamber for causing combustion air to enter said combustion chamber through said first combustion air intake port defined within said upper side wall portion of said combustion chamber and for causing additional ambient air to cool external side wall portions of said combustion chamber.

16. The device of claim 15, wherein said supplemental airflow system comprises:

an air duct fluidically connected to said first combustion air intake port defined within said upper side wall portion of said combustion chamber; and a dual-fan system comprising a first fan configured to conduct air into said air duct fluidically connected to said first combustion air intake port defined within said upper side wall portion of said combustion chamber, and a second fan configured to conduct ambient air onto said external side wall portions of said combustion chamber so as to cool said external side wall portions of said combustion chamber.

17. The device of claim 13, further comprising:

an axially oriented fuel injection manifold disposed within said combustion chamber for distributing fuel into and throughout said combustion chamber.

18. The device of claim 15, further comprising:

an accelerator plate fixedly mounted upon said axially oriented fuel injection manifold, disposed transversely with respect to said axially oriented fuel injection manifold, and having apertures defined therein configured to define multiple flame fronts to be generated within said combustion chamber.

19. The device of claim 16, further comprising:

a flange disposed upon said annularly configured single component intake/exhaust valve and adapted to be disposed adjacent to said accelerator plate when said single component intake/exhaust valve is disposed at said first CLOSED position such that when said single component intake/exhaust valve is disposed at said first CLOSED position said upper wall member of said combustion chamber, said single component intake/exhaust valve, and said accelerator plate together define a pre-combustion chamber.

* * * * *

UNITED STATES PATENT AND TRADEMARK OFFICE

CERTIFICATE OF CORRECTION

PATENT NO. : 8,714,120 B2
APPLICATION NO. : 12/811112
DATED : May 6, 2014
INVENTOR(S) : Joseph S. Adams It is certified that error appears in the above-identified patent and that said Letters Patent is hereby corrected as shown below:

On the title page, add the Related U.S. Application Data as follows:

(60) Provisional Application No. 61/006,305, filed on January 4, 2008.

Signed and Sealed this
Nineteenth Day of August, 2014

Michelle K. Lee

Michelle K. Lee
*Deputy Director of the United States Patent and Trademark Office*